US006745583B2

(12) United States Patent
So et al.

(10) Patent No.: US 6,745,583 B2
(45) Date of Patent: Jun. 8, 2004

(54) DEFROSTING APPARATUS OF AIR CONDITIONER AND METHOD THEREOF

(75) Inventors: Min Ho So, Seoul-si (KR); Won Hee Lee, Seoul-si (KR); Chang Min Choi, Koyang-si (KR); Yoon Jei Hwang, Seoul (KR); Deok Huh, Buchun-si (KR); Cheol Min Kim, Kwangmyung-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/337,789

(22) Filed: Jan. 8, 2003

(65) Prior Publication Data

US 2004/0003604 A1 Jan. 8, 2004

(30) Foreign Application Priority Data

Jul. 3, 2002 (KR) ..... 10-2002-0038374

(51) Int. Cl.[7] ..... F25B 47/02

(52) U.S. Cl. ..... 62/156; 62/81; 62/277; 62/224

(58) Field of Search ..... 62/151, 155, 156, 62/140, 81, 277, 278, 204, 205, 206, 210, 211, 212, 222, 223, 224, 225

(56) References Cited

U.S. PATENT DOCUMENTS 4,215,554 A * 8/1980 Pohl ..... 62/156
4,882,908 A * 11/1989 White ..... 62/156
5,669,222 A * 9/1997 Jaster et al. ..... 62/277
5,941,085 A * 8/1999 Jeon ..... 62/81

* cited by examiner

*Primary Examiner*—Harry B. Tanner
(74) *Attorney, Agent, or Firm*—Greenblum & Berstein, P.L.C.

(57) ABSTRACT

Disclosed are a defrosting apparatus of an air conditioner and a method thereof. The defrosting apparatus includes a temperature sensor for sensing a pipe temperature of an outdoor heat exchanger and an outdoor temperature; a comparator for comparing the sensed pipe temperature of the outdoor heat exchanger and the sensed outdoor temperature, and generating and outputting a comparison signal; and a valve controller for increasing an opening value of an LEV (Linear Expansion Valve) at a defrosting operation and decreasing the opening value of the LEV at a defrosting operation termination. The apparatus and the method can increase efficiency of the defrosting operation and reduce a period of time required for performing the defrosting operation by determining the defrosting operation based on a difference between a pipe temperature of an outdoor heat exchanger and an outdoor temperature and increasing an opening value of an LEV at the defrosting operation.

10 Claims, 4 Drawing Sheets

DEFROSTING APPARATUS OF AIR CONDITIONER AND METHOD THEREOF

BACKGROUND OF THE INVENTION

1. Field of the Invention

The present invention relates to a defrosting apparatus of an air conditioner and a method thereof, and more particularly to a defrosting apparatus of an air conditioner and a method thereof, the apparatus and method being capable of reducing a period of time needed for carrying out a defrosting operation where the defrosting operation is carried out at a heating operation, and simultaneously increasing efficiency of the defrosting operation.

2. Description of the Related Art

Conventionally, an air conditioner includes a compressor for changing a coolant of a low-temperature and low-pressure gas state to a coolant of a high-temperature and high-pressure gas state; a condenser for changing the coolant of the high-temperature and high-pressure gas state to a coolant of a medium-temperature and high-pressure liquid state; an expansion device for changing the coolant of the medium-temperature and high-pressure liquid state to a coolant of a low-temperature and low-pressure liquid state; and a vaporizer for vaporizing the coolant of the low-temperature and low-pressure liquid state.

In a heat pump type air conditioner, operations of indoor and outdoor heat exchangers vary with a cooling or heating mode. In the heating mode, the indoor heat exchanger acts as the condenser, and the outdoor heat exchanger acts as the vaporizer. Otherwise, in the cooling mode, the indoor heat exchanger acts as the vaporizer, and the outdoor heat exchanger acts as the condenser.

A recent air conditioner can vary capacity for coolant compression of a compressor on the basis of a cooling or heating load using a plurality of compressors having different capacities, thereby improving efficiencies of cooling and heating operations.

As shown in FIG. 1, the conventional heat pump type air conditioner having a plurality of compressors includes first and second compressors 11 and 12 for compressing coolants to high-temperature and high-pressure gas coolants; an indoor heat exchanger 14 for performing heat exchange with the coolants, compressed in the first and second compressors 11 and 12, and indoor air, and condensing the coolants to a medium-temperature and high-pressure liquid coolant; and indoor fan 14*a* for ventilating the indoor air to the indoor heat exchanger 14, an LEV (Linear Expansion Valve) 15 for decompressing the coolant passing through the indoor heat exchanger 14 to a low-temperature and low-pressure liquid coolant; an outdoor heat exchanger 16 for performing heat exchange with the coolant passing through the LEV 15 and outdoor air; an outdoor fan 16*a* for ventilating the outdoor air to the outdoor hear exchanger 16; an accumulator 17 for supplying only a gas phase coolant to the first and second compressors 11 and 12 by separating a liquid coolant from a two-phase coolant passing through the outdoor heat exchanger 16; check valves 11*a* and 12*a* for preventing backflow of the coolants compressed by the first and second compressors 11 and 12; and a four-way valve 13 for changing roles of the indoor and outdoor heat exchangers 14 and 16 by switching paths of the coolants passing through the first and second compressors 11 and 12.

The heat pump type air conditioner described above carries out a defrosting operation to remove frost because the frost can be formed in the outdoor heat exchanger due to a low outdoor temperature at a heating operation.

In the defrosting operation, if a microcomputer (not shown) receives a signal generated due to frost formation in the heat exchanger, the microcomputer issues a control signal to a system controller 18. The system controller 18 enables the four-way valve 13 to switch the paths, thereby temporarily switching the heating mode of the air conditioner to the cooling mode so that high-temperature and high-pressure coolant gases compressed by the compressors 11 and 12 can be transferred to the outdoor heat exchanger 16.

Since a high-temperature coolant passes through the outdoor heat exchanger 16, the frost formation of the heat exchanger is removed.

However, where the air conditioner is switched from the heating mode to the cooling mode to perform the defrosting operation, there are problems in that a period of time required for the defrosting operation cannot be reduced and hence efficiency of the defrosting operation is degraded because an amount of coolant passing through the outdoor heat exchanger 16 is constant.

SUMMARY OF THE INVENTION

Therefore, the present invention has been made in view of the above problems, and it is an object of the present invention to provide a defrosting apparatus of an air conditioner and a method thereof, the apparatus and method being capable of reducing a period of time needed for carrying out a defrosting operation where the defrosting operation is carried out at a heating operation, and simultaneously increasing efficiency of the defrosting operation, by increasing an amount of coolant passing through an outdoor heat exchanger.

In accordance with one aspect of the present invention, the above and other objects can be accomplished by the provision of a defrosting apparatus of an air conditioner having compressors, an indoor heat exchanger, an outdoor heat exchanger, a switching valve arranged between the compressors and the indoor and outdoor heat exchangers for switching a coolant path, an LEV (Linear Expansion Valve) arranged between the indoor and outdoor heat exchangers, and a system controller for controlling the switching valve where frost is formed in the outdoor heat exchangers at a heating operation and performing a defrosting operation, comprising: a temperature sensor for sensing a pipe temperature of the outdoor heat exchanger and an outdoor temperature; a comparator for comparing the sensed pipe temperature of the outdoor heat exchanger and the sensed outdoor temperature, and generating and outputting a comparison signal; and a valve controller for increasing an opening value of the LEV at a defrosting operation and decreasing the opening value of the LEV at a defrosting operation termination.

In accordance with another aspect of the present invention, there is provided a defrosting method of an air conditioner, which performs a defrosting operation by controlling a switching valve arranged between compressors and indoor and outdoor heat exchangers and switching a coolant path where frost is formed in the outdoor heat exchanger at a heating operation, comprising the steps of: a) opening an LEV (Linear Expansion Valve) arranged between the indoor and outdoor heat exchangers on the basis of a first opening value and performing the heating operation; b) sensing a pipe temperature of the outdoor heat exchanger and an outdoor temperature; and c) opening the LEV by a second opening value greater than the first opening value where the pipe temperature of the outdoor heat exchanger is a specific value or more lower than the outdoor temperature, and performing the defrosting operation.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
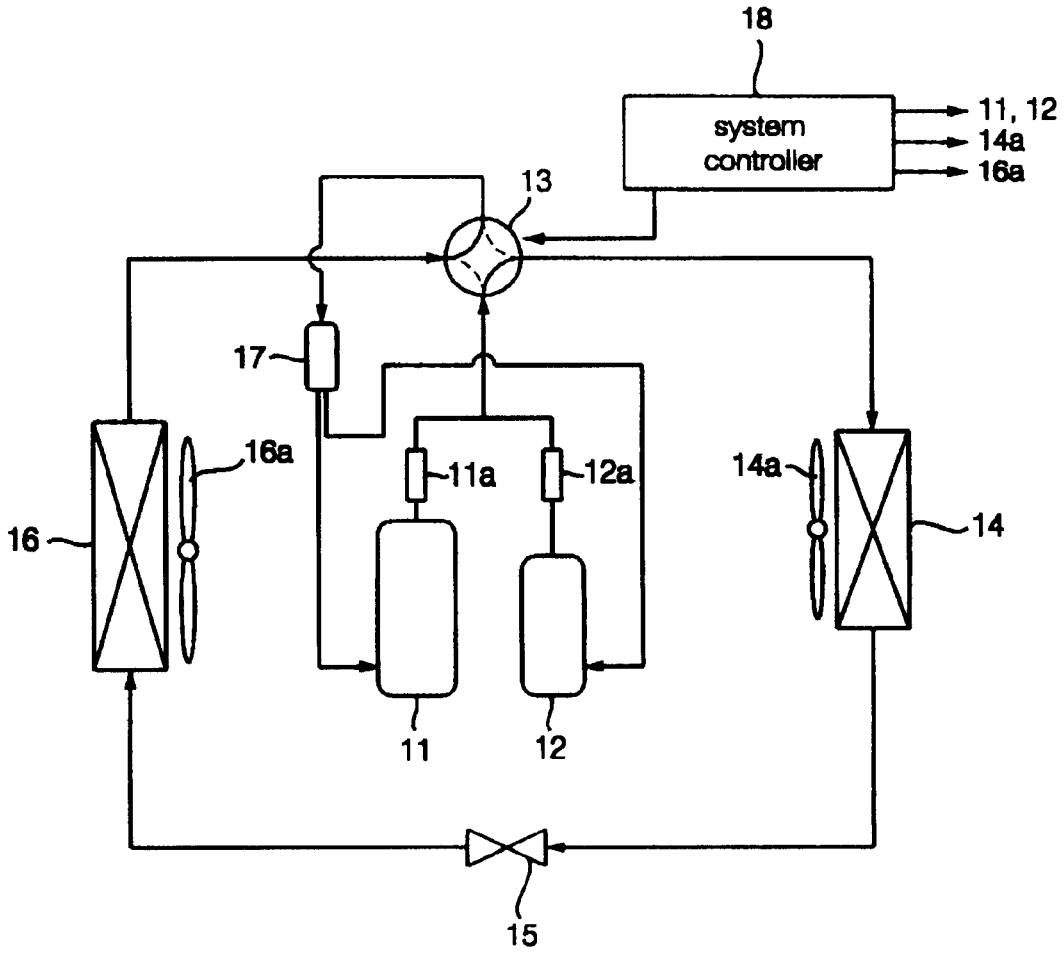
FIG. 1 is a view illustrating a configuration of a conventional heat pump type air conditioner.

Now, preferred embodiments of the present invention will be described in detail with reference to the annexed drawings. In the drawings, the same or similar elements are denoted by the same reference numerals even though they are depicted in different drawings.

Figure 2:
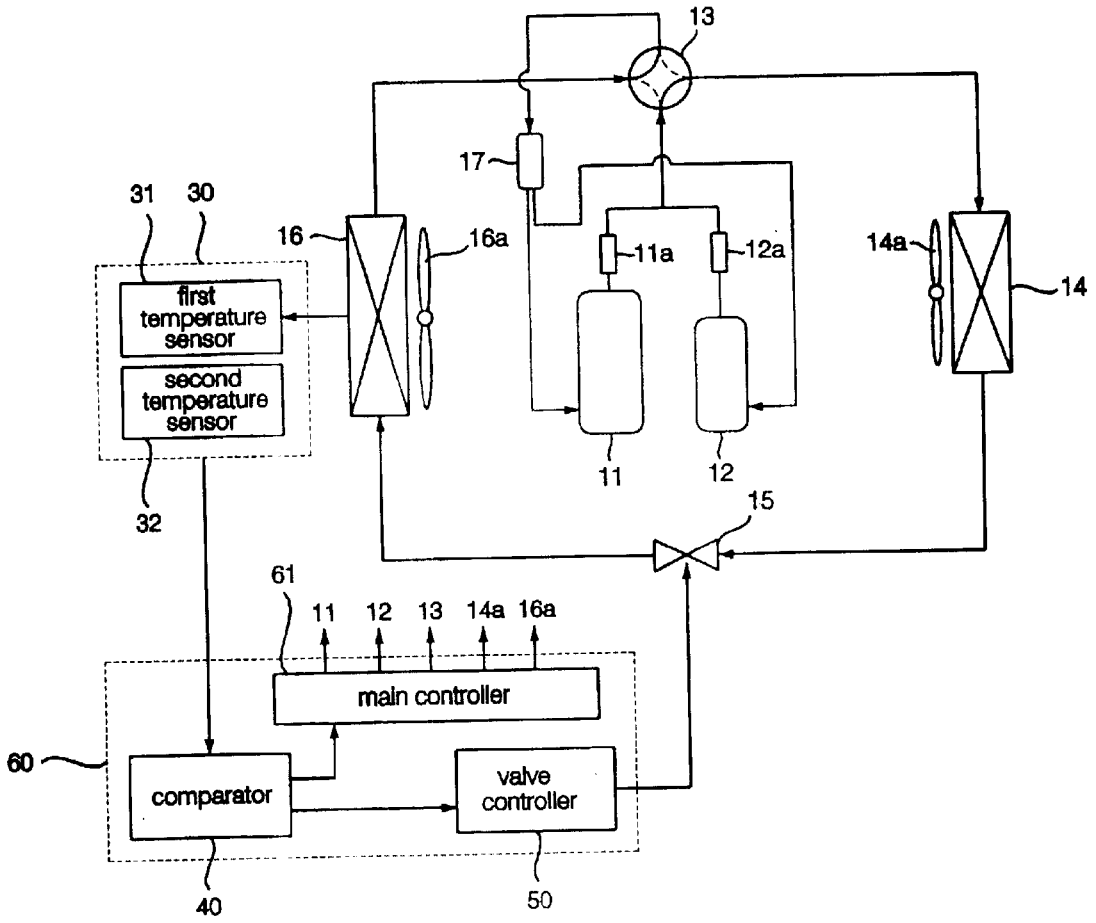
FIG. 2 is a block diagram illustrating a defrosting apparatus of a heat pump type air conditioner in accordance with an embodiment of the present invention.

As shown in FIG. 2, an air conditioner in accordance with the present invention includes first and second compressors 11 and 12, an indoor heat exchanger 14, an indoor fan 14*a* for ventilating indoor air to the indoor heat exchanger 14, an outdoor heat exchanger 16, an outdoor fan 16*a* for ventilating outdoor air to the outdoor heat exchanger 16, an accumulator 17 for supplying only gas phase coolants to the first and second compressors 11 and 12 by separating a liquid coolant from coolants; check valves 11*a* and 12*a* for preventing backflow of compressed coolants; a four-way valve 13 for switching paths of the coolants passing through the first and second compressors 11 and 12; and a system controller 60 for controlling the first and second compressors 11 and 12, the four-way valve 13, the indoor fan 14*a*, the outdoor fan 16*a* and an LEV (Linear Expansion Valve) 15.

The two compressors as described above are employed, but the number of compressors is variable according to use and requirements. Furthermore, coolant compression capacities of the compressors can be variable according to use and requirements.

Where frost is formed in the outdoor heat exchanger 16 due to a low outdoor temperature at a heating operation in the air conditioner described above, the system controller 60 issues a control signal and enables the four-way valve 13 to switch a coolant path to a cooling mode. The system controller 60 stops an operation of the outdoor fan 16*a* to perform a defrosting operation. A defrosting apparatus of the air conditioner in accordance with the present invention includes a temperature sensor 30 for sensing a temperature of a pipe of the outdoor heat exchanger 16 and an outdoor temperature; a comparator 40 for generating and outputting a comparison signal by comparing the pipe temperature of the outdoor heat exchanger 16 and the outdoor temperature; and a valve controller 50 for increasing or decreasing an opening value of the LEV 15 in response to the comparison signal.

The comparator 40 and the valve controller 50 are included in the system controller 60 for controlling an entire operation of the air conditioner.

The temperature sensor 30 includes a first temperature sensor 31 for sensing the pipe temperature of the outdoor heat exchanger 16; and a second temperature sensor 32 for sensing the outdoor temperature. Signals associated with the temperatures sensed by the first and second temperature sensors 31 and 32 are transferred to the comparator 40.

The comparator 40 compares the temperatures sensed by the first and second temperature sensors 31 and 32 and generates and outputs the comparison signal. The comparison signal is generated and outputted on the basis of a difference between the pipe temperature of the outdoor heat exchanger 16 and the outdoor temperature.

The valve controller 50 receives the comparison signal outputted from the comparator 40. Where the comparison signal corresponds to a signal for removing the frost of the outdoor heat exchanger, the valve controller 50 increases the opening value of the LEV 15. Where the comparison signal corresponds to a signal for releasing the defrosting operation, the valve controller 50 decreases the opening value of the LEV 15.

The system controller 60 carries out the defrosting operation where only one of the first and second compressors 11 and 12 is operated and the pipe temperature of the outdoor heat exchanger 16 is a first predetermined value or more lower than the outdoor temperature. The valve controller 50 increases the opening value of the LEV 15 so that the defrosting operation is performed on the basis of the increased opening value of the LEV 15 as compared with the opening value of the LEV 15 at the heating operation.

Further, where the first and second compressors 11 and 12 are operated, the defrosting operation is performed and the opening value of the LEV 15 is increased, if the pipe temperature of the outdoor heat exchanger 16 is a second predetermined value or more lower than the outdoor temperature, whereby frequent defrosting operations and degradation of a heating effect due to the increased heating load according to the operations of first and second compressors 11 and 12 can be prevented. The second predetermined value is greater than the first predetermined value.

Further, at the time of a defrosting operation termination, the LEV controller 50 decreases the opening value of the LEV 15 increased at the defrosting operation so that the LEV 15 can have an opening value between an opening value at the heating operation and an opening value at the defrosting operation. If a predetermined period of time passes after the heating operation is re-performed, the opening value of the LEV 15 is decreased to that of the LEV 15 at the heating operation.

Figure 3:
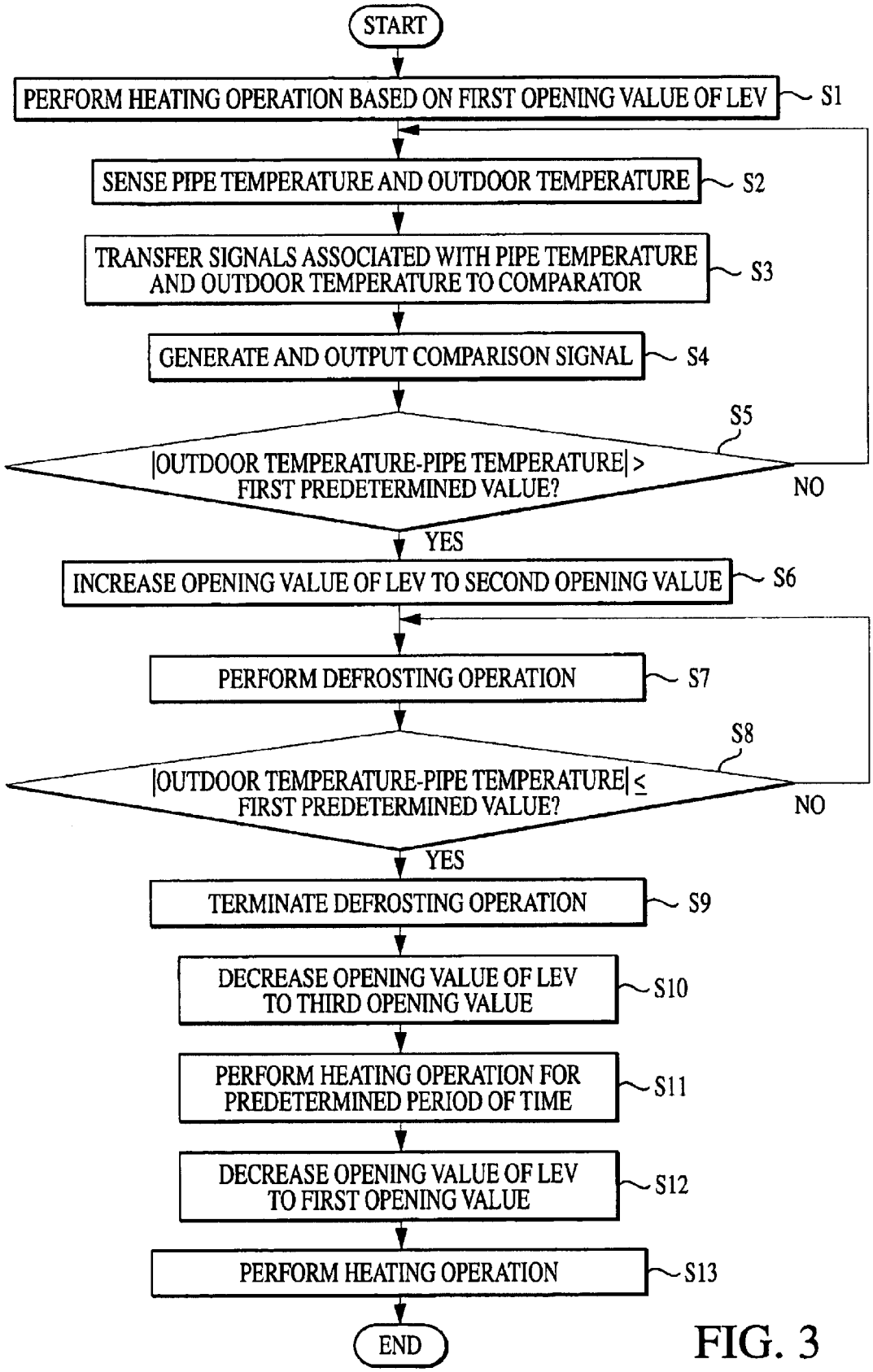
FIG. 3 is a flow chart illustrating a defrosting method of a heat pump of the air conditioner.

A defrosting method of the air conditioner in accordance with the present invention will be described with reference to FIG. 3.

At a first step S1, the air conditioner performs the heating operation based on a first opening value of the LEV 15 according to a target overheating degree.

At a second step S2, the first and second temperature sensors 31 and 32 continuously sense a pipe temperature of the outdoor heat exchanger 16 and an outdoor temperature at the heating operation at the first step.

At a third step S3, signals associated with the pipe temperature of the outdoor heat exchanger 16 and the outdoor temperature sensed at the second step are transferred to the comparator 40.

At a fourth step S4, the comparator 40 generates and outputs a comparison signal based on a difference between the pipe temperature of the outdoor heat exchanger 16 and the outdoor temperature corresponding to the signals transferred at the third step.

At fifth steps S5, S6 and S7, if the comparison signal outputted at the fourth step is transferred to the valve controller 50, the valve controller 50 controls the opening value of the LEV 15 in response to the comparison signal. Where the pipe temperature of the outdoor heat exchanger 16 is the first predetermined value or more lower than the outdoor temperature, the LEV 15 has an increased second opening value as compared with the first opening value and then the defrosting operation is performed.

In particular, where the first and second compressors 11 and 12 are operated, the defrosting operation is performed and the opening value of the LEV 15 is increased to have the second opening value, if the pipe temperature of the outdoor heat exchanger 16 is a second predetermined value or more lower than the outdoor temperature, wherein the second predetermined value is greater than the first predetermined value.

For example, if only one of the first and second compressors 11 and 12 is operated, and the first predetermined value is set to "9" on the condition that the pipe temperature of the outdoor heat exchanger 16 is 0° C. or less, and the outdoor temperature is 11° C. or less, the opening value of the LEV 15 is increased to the second opening value where the pipe temperature of the outdoor heat exchanger 16 is 9° C. or more lower than the outdoor temperature, and the defrosting operation is performed.

Further, if the first and second compressors 11 and 12 are operated and the second predetermined value is set to "10" on condition that the pipe temperature of the outdoor heat exchanger 16 is 6° C. or less, the LEV 15 has the second opening value when the pipe temperature of the outdoor heat exchanger 16 is 10° C. or more lower than the outdoor temperature, and the defrosting operation is performed.

Thus, at the defrosting operation, the LEV 15 has the second opening value and hence an amount of coolant is increased to remove the frost.

At sixth steps S8 and S9, if a predetermined period of time passes at the defrosting operation or the pipe temperature of the outdoor heat exchanger 16 increases by the first predetermined value, the defrosting operation is terminated.

At seventh step S10, when the defrosting operation is terminated at the sixth steps, the opening value of the LEV 15 is decreased to be a third opening value between the first and second opening values.

At eighth step S11, the LEV 15 has the third opening value, and the heating operation is performed again.

At ninth steps S12 and S13, the opening value of the LEV 15 is decreased to be the first opening value, and the heating is performed.

Figure 4:
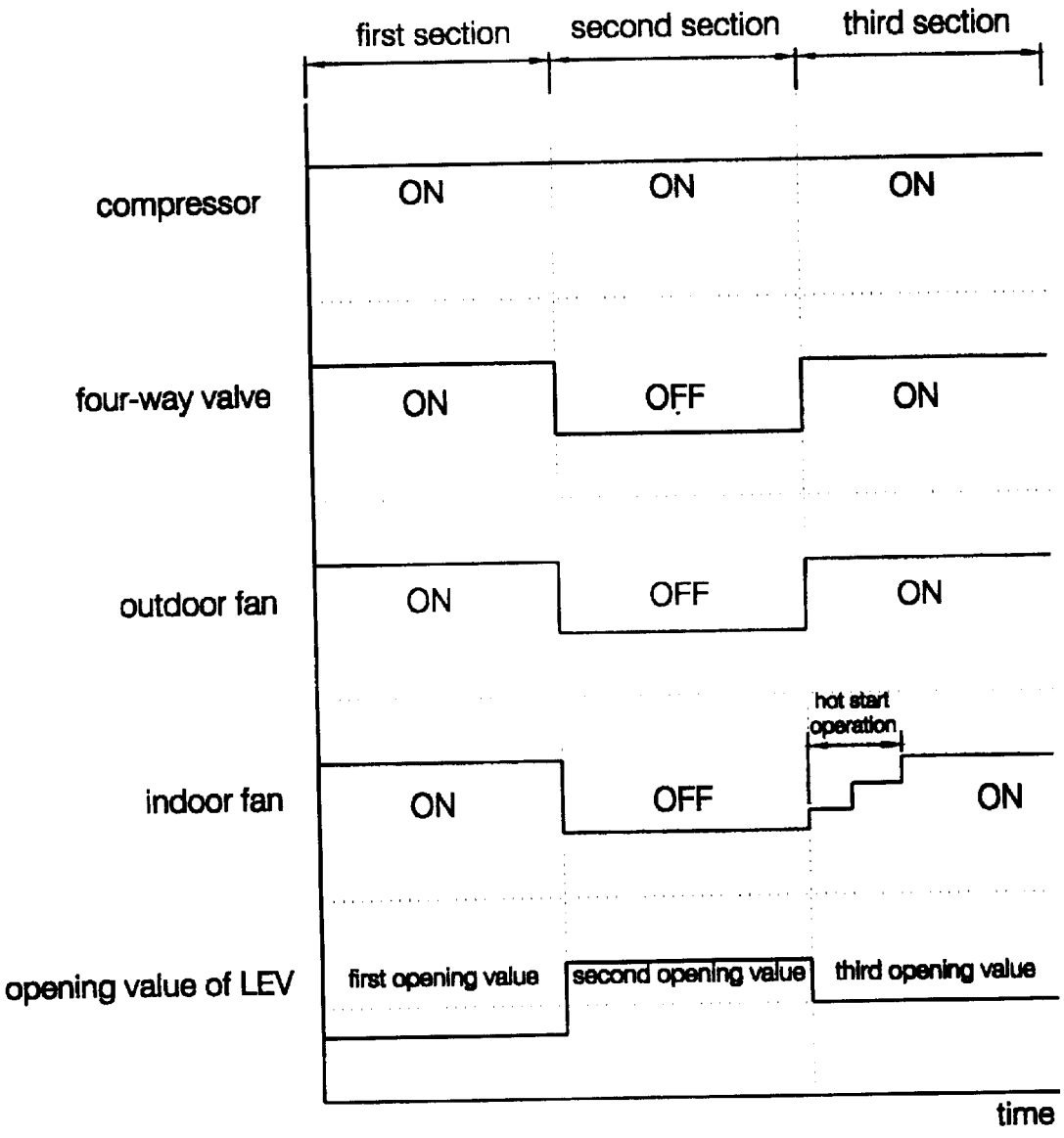
FIG. 4 is a timing chart illustrating operating states of respective components when the heat pump type air conditioner carries out the defrosting operation in accordance with the present invention.

Hereafter, operating states of the compressors 11 and 12, the four-way valve 13, the indoor fan 14*a*, the outdoor fan 16*a* and the LEV 15 in relation to the defrosting method of a heat pump type system having a plurality of compressors will be described. Referring to FIG. 4, in a first section, that is, before the defrosting operation, the compressors 11 and 12, the four-way valve 13, the indoor fan 14*a* and the outdoor fan 16*a* maintain turn-on states, the LEV 15 has the first opening value, and the heating operation is performed.

At this time, where the pipe temperature of the outdoor heat exchanger 16 decreases by the first predetermined value, the second predetermined value or more, the defrosting operation is performed as shown in the second section to remove the frost formation.

In a second section after the first section, because the compressors 11 and 12 maintain the turn-on states, the indoor fan 14*a* and the outdoor fan 16*a* are turned off, and the four-way valve 13 switches a coolant path to switch a heating cycle to a cooling cycle, the heating cycle is in an off state.

The LEV 15 in the second section has the second opening value increased by a predetermined amount as compared with the first opening value.

Finally, where the defrosting operation is terminated in the second section, the compressors 11 and 12 maintain the turn-on states in a third section as in the first and second sections, and the indoor fan 14*a* and the outdoor fan 16*a* are switched from the turn-off states to the turn-on states. At this time, a hot start operation is performed at a time when the indoor fan 14*a* is switched from the cooling cycle to the heating cycle.

The four-way valve 13 switches the coolant path in the second section in order to switch a cycle to the heating cycle. Thus, the heating cycle is in an on state.

At this time, the LEV 15 has the third opening value between the first opening value and the second opening value.

Subsequently, the defrosting method of the air conditioner in accordance with the present invention can reduce a period of time required for performing a defrosting operation by changing an opening value of an LEV so that an efficient defrosting operation based on a difference between a pipe temperature of an outdoor heat exchanger and an outdoor temperature can be performed.

The preferred embodiments and the accompanying drawings of the present invention have been disclosed for illustrative purposes, the present invention is not limited to the preferred embodiments and the accompanying drawings. When a defrosting operation is performed, a difference between a pipe temperature of an outdoor heat exchanger and an outdoor temperature can be changed if desired, and applications are enabled so that the defrosting operation can be performed on various conditions.

As apparent from the above description, the present invention provides a defrosting apparatus of an air conditioner and a method thereof, the apparatus and the method being capable of increasing efficiency of an defrosting operation and reducing a period of time required for performing the defrosting operation by determining the defrosting operation based on a difference between a pipe temperature of an outdoor heat exchanger and an outdoor temperature and increasing an opening value of an LEV at the defrosting operation.

What is claimed is:

1. A defrosting apparatus of an air conditioner having compressors, an indoor heat exchanger, an outdoor heat exchanger, a switching valve arranged between the compressors and the indoor and outdoor heat exchangers for switching a coolant path, an LEV (Linear Expansion Valve) arranged between the indoor and outdoor heat exchangers, and a system controller for controlling the switching valve where frost is formed in the outdoor heat exchangers at a heating operation and performing a defrosting operation, comprising:

a temperature sensor for sensing a pipe temperature of the outdoor heat exchanger and an outdoor temperature;

a comparator for comparing the sensed pipe temperature of the outdoor heat exchanger and the sensed outdoor temperature, and generating and outputting a comparison signal; and a valve controller for increasing an opening value of the LEV at a defrosting operation and decreasing the opening value of the LEV at a defrosting operation termination.

2. The defrosting apparatus as set forth in claim 1, wherein the temperature sensor includes:

a first temperature sensor for sensing the pipe temperature of the outdoor heat exchanger; and a second temperature sensor for sensing the outdoor temperature.

3. The defrosting apparatus as set forth in claim 1, wherein the valve controller increases the opening value of the LEV so that the defrosting operation can be performed where the pipe temperature of the outdoor heat exchanger is a predetermined value or more lower than the outdoor temperature.

4. The defrosting apparatus as set forth in claim 3, wherein the valve controller decreases the opening value of the LEV to within a range between an opening value at the heating operation and an increased opening value at the defrosting operation, when the defrosting operation is terminated.

5. The defrosting apparatus as set forth in claim 1, wherein the valve controller performs the defrosting operation by increasing the opening value when only part of the compressors of the air conditioner is operated and the difference between the pipe temperature of the outdoor heat exchanger and the outdoor temperature is greater than a first predetermined value, and increasing the opening value where the compressors are operated and the difference between the pipe temperature of the outdoor heat exchanger and the outdoor temperature is a second predetermined value greater than the first predetermined value.

6. A defrosting method of an air conditioner, which performs a defrosting operation by controlling a switching valve arranged between compressors and indoor and outdoor heat exchangers and switching a coolant path where frost is formed in the outdoor heat exchanger at a heating operation, comprising the steps of:

a) opening an LEV (Linear Expansion Valve) arranged between the indoor and outdoor heat exchangers on the basis of a first opening value and performing the heating operation;

b) sensing a pipe temperature of the outdoor heat exchanger and an outdoor temperature; and c) opening the LEV by a second opening value increased greater than the first opening value where the pipe temperature of the outdoor heat exchanger is a specific value or more lower than the outdoor temperature, and performing the defrosting operation.

7. The defrosting method as set forth in claim 6, further comprising the step of:

d) after the step c), stopping the defrosting operation where the difference between the pipe temperature of the outdoor heat exchanger and the outdoor temperature is the specific value or less or after a predetermined period of time passes, decreasing the opening value of the LEV to a value less than the second opening value, and performing the heating operation for a predetermined period of time.

8. The defrosting method as set forth in claim 7, further comprising the step of:

e) after the step d), decreasing the opening value of the LEV to the first opening value at the heating operation, and performing the heating operation.

9. The defrosting method as set forth in claim 7, wherein the opening value of the LEV decreased at the step d) is an opening value between the first opening value contained in the step a) and the second opening value contained in the step c).

10. The defrosting method as set forth in claim 6, wherein a specific value being a difference between the pipe temperature of the outdoor heat exchanger performing the defrosting operation and the outdoor temperature when the compressors included in the air conditioner are operated is greater than the specific value when part of the compressors is stopped.

* * * * *